US008474821B2

(12) United States Patent
Ko

(10) Patent No.: US 8,474,821 B2
(45) Date of Patent: Jul. 2, 2013

(54) BLACKJACK DOUBLE DOWN OPTIONS

(75) Inventor: Shenli Ko, Las Vegas, NV (US)

(73) Assignee: Betwiser Games, LLC, Las Vegas, NV (US)

( * ) Notice: Subject to any disclaimer, the term of this patent is extended or adjusted under 35 U.S.C. 154(b) by 771 days.

(21) Appl. No.: 12/592,607

(22) Filed: Nov. 30, 2009

(65) Prior Publication Data

US 2010/0133752 A1 Jun. 3, 2010

Related U.S. Application Data

(60) Provisional application No. 61/200,451, filed on Nov. 28, 2008.

(51) Int. Cl.
*A63F 1/00* (2006.01)

(52) U.S. Cl.
USPC ..... 273/292

(58) Field of Classification Search
None
See application file for complete search history.

(56) References Cited

U.S. PATENT DOCUMENTS

| | | | | |
|---|---|---|---|---|
| 5,255,915 | A | 10/1993 | Miller | |
| 5,337,973 | A | 8/1994 | Matsumoto et al. | |
| 5,377,994 | A | 1/1995 | Jones | |
| 5,615,888 | A | 4/1997 | Lofink et al. | |
| 5,632,485 | A * | 5/1997 | Woodland et al. | 273/292 |
| 5,816,575 | A * | 10/1998 | Keller | 273/292 |
| 5,897,436 | A | 4/1999 | Singer et al. | |
| 5,979,897 | A | 11/1999 | Grossman | |
| 6,229,534 | B1 | 5/2001 | Gerra et al. | |
| 6,402,148 | B1 * | 6/2002 | Saruwatari | 273/292 |
| 6,485,020 | B1 * | 11/2002 | Broadnax | 273/292 |
| 6,523,829 | B1 * | 2/2003 | Walker et al. | 273/292 |
| 6,598,879 | B2 | 7/2003 | Spur et al. | |
| 6,604,741 | B1 | 8/2003 | Snow | |
| 6,607,443 | B1 | 8/2003 | Miyamoto et al. | |
| 6,877,748 | B1 * | 4/2005 | Patroni et al. | 273/292 |
| 6,932,343 | B1 * | 8/2005 | Miller | 273/292 |
| 7,329,178 | B1 * | 2/2008 | Moore et al. | 463/12 |
| 7,384,045 | B1 * | 6/2008 | David | 273/292 |
| 7,549,642 | B2 * | 6/2009 | Centrone | 273/292 |

OTHER PUBLICATIONS

U.S. Appl. No. 09/179,748, filed Oct. 28, 1998, Miyamoto, et al.
U.S. Appl. No. 10/764,827, filed Jan. 26, 2004, Smith, et al.
U.S. Appl. No. 10/764,994, filed Jan. 26, 2004, Smith, et al.
U.S. Appl. No. 10/764,995, filed Jan. 26, 2004, Smith ,et al.

* cited by examiner

*Primary Examiner* — Kurt Fernstrom
*Assistant Examiner* — Dolores Collins
(74) *Attorney, Agent, or Firm* — Mark A. Litman & Associates, P.A.

(57) ABSTRACT

A method for conducting blackjack-style wagering games includes favorable player options to enhance its appeal. Various double down options are available for the player to either increase his win or reduce his loss when doubling down with an additional wager.

12 Claims, No Drawings

BLACKJACK DOUBLE DOWN OPTIONS

CROSS REFERENCE TO RELATED APPLICATIONS

This application claims the benefit of U.S. Provisional Patent Application No. 61/200,451, filed on Nov. 28, 2008.

BACKGROUND OF THE INVENTION

The present invention relates to blackjack-style wagering games. More particularly, the present invention includes methods for playing blackjack-style games which enhance its appeal by providing more options in favor of the player.

Blackjack is generally conducted using one or more decks of fifty-two cards each. Each player makes a wager to receive two cards. A dealer also receives two cards, one of which is exposed. Each player forms a final player hand by opting to stand, hit (draw more cards), double down with an additional wager, or split the pair if the two cards are of the same rank. If the player doubles down, he has to put up an additional wager equal to his initial wager and then the dealer will deal him only one card. If the player hits and busts (i.e., the sum of the cards in his hand goes over a target value of 21), then the player loses his wager immediately. If the player splits a pair, he must put up an additional wager equal to his initial wager and split the pair into two hands. Where the house rules allow for double down after split, the player may double down after splitting a pair by putting up a double down wager next to the wager on the hand being doubled. Where the house rules allow for surrender, the player may surrender his hand and forfeit half the wager.

After each player has formed a final player hand or busted, a final dealer hand is formed. If the initial dealer hand is not 17 or greater, additional cards are drawn to the dealer hand until his hand is 17 or greater. If the dealer busts (i.e. has a hand value greater than 21), all players who did not already bust are rewarded. Otherwise, the numerical value of each player hand is compared to the numerical value of the dealer hand. In determining a numerical hand value, aces count one or eleven, face cards count ten, and all other cards count their face value. For each comparison, whoever has a hand closer to 21 wins. If the dealer hand and the player hand are equal, the player's wager is returned.

A blackjack variant known as Spanish 21 is disclosed in U.S. Pat. No. 5,615,888. Spanish 21, dealt with reduced decks with four tens removed from each deck, provides some rule modifications that favor the player. For example, the player is allowed to not only double down on any number of cards but also take back the double down wager if he dislikes the double down card dealt to him.

Another blackjack variant known as Super Fun 21 is disclosed in U.S. Pat. No. 5,979,897. Super Fun 21, dealt with standard decks of 52 cards, provides not only the same double down options as Spanish 21 but also the option of surrendering half the bet on any hand including after splitting.

Another blackjack variant is disclosed in U.S. Pat. No. 6,598,879. An optional side bet known as "hit insurance" is provided such that a player may insure his hand against being broken (busted) if he draws one or more cards.

Another blackjack variant is disclosed in U.S. Pat. No. 6,604,741 entitled "Split card feature during continued play of blackjack." If a last additional card dealt matches a value of any previously dealt card, the player is allowed to separate the last additional card into a second hand. For example, a single card may be split off by the player after taking a hit when the hit card matches an earlier dealt card, such as one or the other of the two first cards in the original hand or another hit card.

Another blackjack variant is disclosed in U.S. Pat. No. 7,384,045. A "double down split" option is provided so that the player who wishes to double down can put up an additional wager for an additional hand that shares the original two cards dealt to him. For example, a player who receives 9-2 in his original two cards may elect to "split double" and create a second hand by matching his original wager. Now the two hands will share the 9-2 as their starting hand but will receive their own double down card respectively.

Another blackjack variant is disclosed in U.S. Pat. No. 7,329,178 entitled "Blackjack game with discard option." The player is allowed the option to discard one of his initial two cards by paying a discard fee in hopes of drawing a new card that can improve his hand.

The above prior art inventions provide blackjack players with options that either enable them to make more lucrative bets or mitigate possible frustrations. The present invention also provides the player more options in addition to the common double down and pair split options. The options are described below:

SUMMARY OF THE INVENTION

An improved method for conducting a blackjack card game uses A) physical playing cards at each player position or B) a processor sending virtual images of playing cards to a display system at each player position. The blackjack card game is played between a dealer and at least one player at a physical gaming table according to the predetermined rules of blackjack card games utilizing playing cards where all face cards count ten, aces count one or eleven, and all other cards count their face value. Each player makes an initial wager and the dealer randomly distributes an initial player hand of two cards to each player and at least one card to the dealer. The improved method allows the player, after the player to exercise the double down option by placing a double down wager and taking a single hit card, and then to resolve the player hand by using at least one, but not necessarily all of the following steps:

i) If the player doubles down on a predetermined count of his hand and the player's count total equals a predetermined value after taking the hit card, the player loses only one of the initial wager and the double down wager if the dealer hand beats the player hand;

ii) If the player doubles down on a total of 10 and draws a 10, the player hand will push or lose one of the initial wager and the double down wager if the dealer hand has 21; and iii) If one or more of the following criteria can be satisfied, reward the player at a rate against at least one player wager of more than 1 to 1 if the player beats the dealer hand:

a) the final player hand has a predetermined total;

b) the hit card has a predetermined rank;

c) the point spread between the final player hand the final dealer hand matches a predetermined value or range;

d) the dealer's up card or hole card has a predetermined rank or falls within a predetermined range; and e) the final dealer hand has a predetermined total.

Hit After Double Down

If a player doubles down and draws an undesirable card, he has the option to forfeit the double down bet and then hit his hand till he stands or busts. For example, a player hand has a total of 10 versus a dealer 9 up. The player doubles down and draws a Deuce. The player now can forfeit the double down bet in exchange for an option of drawing more cards as if he had never doubled down.

Double Down Bonus

In certain situations the player can be paid bonus odds on their double down wager. For example, if the player doubles down on a 2-card 10 and draws an ace, then the player can be paid more than even money. In another embodiment, the differential between the player hand point total and the dealer hand point total, which is known as the point spread, can be used to determine the odds to pay. For example, if the player hand has 21 after drawing the double down card and the dealer hand has 17, the player will be rewarded more than 1 to 1. In another embodiment, the bonus odds can be based on the dealer's up card. If the dealer's up card is a predetermined rank and the player wins, then the player will be paid more than even money. Alternatively the dealer's hole card instead of the up card can be used to serve the same purpose. In another embodiment, if the dealer's up card is any 2 through 6 and the player beats certain dealer hands, then more than even money can be paid. An example of the embodiment is given below:

| Dealer Up Card | Dealer Hand Total | Double Down Bonus Odds |
|---|---|---|
| 2 thru 6 | 20 | 3 to 1 |
| 2 thru 6 | 19 | 2 to 1 |

It should be noted that any one or combination of the above criteria can be selected to implement the double down bonus odds. For example, the point spread and the dealer up card criteria can be selected such that the bonus odds will be paid if the criteria are satisfied.

Double Down Relief

If a player doubles down on a total of 11 and draws an Ace, the player will lose only the original wager if his hand loses. If a player doubles down on a total of 10 and draws a 2, the player will lose only the original wager if his hand loses. For example, suppose the player who doubles down on a hand of 6 and 4 draws a 2 for a total of 12 (6+4+2). Then the dealer makes a hand that beats his 12. The player will lose only his original wager and his additional double down wager will push.

Alternatively, we can allow the player to draw additional cards in the above cases.

Double Down Bad-Beat Relief

If a player doubles down on a total of 10 and draws a 10, the player hand will push or lose one of the initial wager and the double down wager if the dealer hand has 21. (20 bad beat by 21)

It should be noted that the invention can be adapted to any blackjack-style games in which pair splitting and double down are allowed, such as Spanish 21, No Bust 21 and Super Fun 21.

The present invention may include a device for carrying out a method according to an embodiment of the present invention. The device could take any form, including a general use computer, such as a PC, a specific use computer, such as an electronic gaming machine, a hand held device or cellular telephone, or any other type of electronic device.

One way of describing the improved method technology according to the present disclosure for conducting a blackjack card game is using A) physical playing cards at each player position or B) a processor sending virtual images of playing cards to a display system at each player position (as described in greater detail herein). The blackjack card game is played between a dealer and at least one player at a physical gaming table according to the predetermined rules of blackjack card games using playing cards where all face cards count ten, aces count one or eleven, and all other cards count their face value. Each player makes an initial wager and the dealer (real or virtual as described herein) randomly distributes an initial player hand of two cards to each player and at least one card to the dealer. The improved method comprises, after the player exercises the double down option by placing a double down wager and taking a single hit card, resolving the player hand by one of the following steps:

i) Double down relief—If the player doubles down on a predetermined count of his hand and the player's count total equals a predetermined value after taking the hit card, the player loses only one of the initial wager and the double down wager if the dealer hand beats the player hand;

ii) Double down bad-beat relief—If the player doubles down on a total of 10 and draws a 10, the player hand will push or lose one of the initial wager and the double down wager if the dealer hand has 21; and iii) Double down bonus—If one or more of the following criteria can be satisfied, reward the player at a rate against at least one player wager of more than 1 to 1 if the player beats the dealer hand:

a) the final player hand has a predetermined total;

b) the hit card has a predetermined rank;

c) the point spread between the final player hand the final dealer hand matches a predetermined value or range;

d) the dealer's up card or hole card has a predetermined rank or falls within a predetermined range; and e) the final dealer hand has a predetermined total.

With the double down relief rule, the player who has doubled down with an additional wager on a predetermined total of his hand and drawn the predetermined card and forwarded the just one wager may be allowed to draw additional cards. The predetermined count of said player hand may be 11 and said predetermined card may be an ace, or the predetermined count of said player hand may be 10 and the predetermined card is a deuce. In an optional embodiment, the player may be allowed to continue to draw new cards.

With the double down bad-beat relief rule, the player who has doubled down with a double down wager on a predetermined total of his hand may push both his initial wager and the double down wager or lose one of the initial wager and the double down wager if the player draws a predetermined card and the dealer hand has a predetermined count. For example, the predetermined total of the player hand can be 10, the predetermined card that the player draws is a ten-value card, and the predetermined count of said dealer hand is 21.

The double down bonus can be implemented with several criteria. The predetermined total of the player hand may be 21. The predetermined rank of the double down card may be an ace and the predetermined point spread may be at least 2. The predetermined value of the dealer up or hole card may range from 2 through 6 and collectively any set of values therein. For example, if the dealer's up card is a 2, 3, 4, 5 or 6 and a final count on the dealer's hand is 19 or 20 and the player beats the dealer's hand, a bonus on the double down wager is paid, the bonus being a payment on the double down wager of a multiple of the double down wager in excess of 1:1.

Any description of novel technology described herein as an improved method for conducting a blackjack card game is using A) physical playing cards at each player position or B) a processor sending virtual images of playing cards to a display system at each player position (as described herein). The blackjack card game is played between a dealer and at least one player at a physical gaming table according to the predetermined rules of blackjack card games utilizing playing cards where all face cards count ten, aces count one or eleven, and all other cards count their face value. Each player makes an initial wager and the dealer or a virtual dealer randomly distributes an initial player hand of two cards to each player and at least one card to the dealer. An improved method has the player exercising a hit-after-double-down option before the dealer hand is revealed, completed and compared to the player hand to determine the outcome. After the player places a double down wager and takes a single hit card, the player can forfeit the double down wager in exchange for an option of drawing more cards as if the player had never doubled down.

If played in an electronic of partially electronic format (e.g., with physical playing cards and electronic wagering), the table or electronic interaction among players and the house would require the use of essentially standard electronic interfaces and electronic gaming tables and networks, having player input/output interfaces, video screens, and combinations of processors, flash memory, RAM, EEPROM, storage, software, Random Number Generation, protocols among positions, security functions and the like, as needed to properly execute play of the game on the existing formats.

The play of the game may be completed manually on a non-electronic game table, with the dealer using a physical deck(s) of cards, visually identifying the amounts and positions of wagers, manually collecting and paying out wagers, etc. It is possible to incorporate some degree or nearly an entire electronic system into the game table or into the play of the game. Such partial or complete electronic systems may perform such tasks as identifying the existence of a wager (e.g., U.S. Pat. Nos. 6,229,534; 5,337,973; and 5,377,994), or may provide virtual cards from an electronically stored deck of cards (e.g., U.S. Pat. Nos. 5,255,915; and 5,897,436). The games of the present invention could also be executed on a multiple player gaming platform including a simulated virtual dealer, such as the device and system described in U.S. patent application Ser. No. 09/179,748, filed Oct. 28, 1998, now U.S. Pat. No. 6,607,443 and U.S. patent applications Ser. Nos. 10/764,995; 10/764,994; and 10/764,827, each filed on Jan. 26, 2004. The content of these and every patent specification and application specification is hereby and herein incorporated by reference.

Although the invention has been described in detail with reference to several embodiments, additional variations and modifications exist within the scope and spirit of the invention as described and defined in the following claims.

What is claimed:

1. An improved method for conducting a blackjack-style card game using:

a processor sending virtual images of playing cards to a display system at each player position, the blackjack-style card game being played between a dealer position and at least one player position at a physical gaming table according to the predetermined rules of blackjack card games utilizing playing cards where all face cards count ten, aces count one or eleven, and all other cards count their face value, in which the processor recognizes each player position making an initial wager and the processor randomly distributes an initial player position hand of two cards to each player position and at least one card to the dealer position, the improved method comprising after the player position exercises a double down option by placing a double down wager and taking a single hit card, the processor resolving the player position hand by one of the following steps:

i. If the player position doubles down on a predetermined count of his hand and the player's position count total equals a predetermined value after taking the hit card, the processor effects that the player position loses only one of the initial wager and the double down wager if the dealer position hand beats the player position hand;

ii. If the player position doubles down on a total of 10 and draws a 10, the player position hand will be caused by the processor to always push or lose exactly one of the initial wager and the double down wager, if the dealer position hand has 21; and iii. If one or more of the following criteria can be satisfied, reward the player position at a rate against at least one player position wager of more than 1 to 1 if the player position hand beats the dealer position hand:

a) the final player position hand has a predetermined total;

b) the hit card has a predetermined rank;

c) the point spread between the final player position hand the final dealer position hand matches a predetermined value or range;

d) the dealer's position up card or hole card has a predetermined rank or falls within a predetermined range; and e) the final dealer position hand has a predetermined total.

2. The method of claim 1, wherein in step i) said predetermined count of said player position hand is 11 and said predetermined card is an ace.

3. The method of claim 1, wherein in step i) said predetermined count of said player position hand is 10 and said predetermined card is a deuce.

4. The method of claim 1, wherein in step i) the player position is allowed by the processor to draw more cards before the dealer position hand is played out.

5. The method of claim 1, wherein in step iii) a) the predetermined total of said final player position hand is 21.

6. The method of claim 1, wherein in step iii) b) the predetermined rank of said hit card is an ace.

7. The method of claim 1, wherein in step iii) c) the predetermined point spread is at least 2.

8. The method of claim 1, wherein in step iii) d) the predetermined rank of said dealer position up card or hole card ranges from 2 through 6.

9. The method of claim 1, wherein in step iii).d) the dealer's position up card is a 2, 3, 4, 5 or 6, and a final count of the dealer position hand is 19 or 20.

10. An improved method for conducting a blackjack-style card game using a processor sending virtual images of playing cards to a display system at each player position, the blackjack-style card game being played between a dealer position and at least one player position at a physical gaming table according to the predetermined rules of blackjack card games utilizing playing cards where all face cards count ten, aces count one or eleven, and all other cards count their face value, in which the processor identifies where each player position makes an initial wager and the dealer position as a virtual dealer randomly distributes an initial player position hand of two cards to each player position and at least one card to the dealer position , the improved method comprising before the dealer position hand is revealed, completed and compared by the processor to the player position hand to determine a processor determined outcome of the blackjack-style card game, the player position exercising a hit-after-double-down option, wherein after the player position places a double down wager and takes a single hit card, the processor accepts a player position forfeit of the double down wager in exchange for an option of drawing more cards and the processor provides at least one card to the player position hand.

11. An apparatus for playing a blackjack wagering game comprising: a processor; a random number generator; a video display in data communication with the processor; wherein the processor executes software enabling play of a method comprising:

a processor sending virtual images of playing card to a display system at each player position, the blackjack-style card game being played between a dealer position and at least one player position at a physical gaming table according to the predetermined rules of blackjack card games utilizing playing cards where all face cards count ten, aces count one or eleven, and all other cards count their face value, in which the processor recognizes each player position making an initial wager and the processor randomly distributes an initial player position hand of two cards to each player position and at least one card to the dealer position, the improved method comprising after the player position exercises a double down option by placing a double down wager and taking a single hit card, the processor resolving the player position hand by one of the following steps:

i. If the player position doubles down on a predetermined count of his hand and the player's position count total equals a predetermined value after taking the hit card, the processor effects that the player position loses only one of the initial wager and the double down wager if the dealer position hand beats the player position hand;

ii. If the player position doubles down on a total of 10 and draws a 10, the player position hand will be caused by the processor to always push or lose exactly one of the initial wager and the double down wager, if the dealer position hand has 21; and iii. If one or more of the following criteria can be satisfied, reward the player position at a rate against at least one player position wager of more than 1 to 1 if the player position hand beats the dealer position hand:

a) the final player position hand has a predetermined total;

b) the hit card has a predetermined rank;

c) the point spread between the final player position hand the final dealer position hand matches a predetermined value or range;

d) the dealer's position up card or hole card has a predetermined rank or falls within a predetermined range; and e) the final dealer position hand has a predetermined total.

12. An apparatus for playing a blackjack wagering game comprising: a processor; a random number generator; a video display in data communication with the processor; wherein the processor executes software enabling play of the improved method for conducting a blackjack-style card game a processor sending virtual images of playing cards to a display system at each player position, the blackjack-style card game being played between a dealer position and at least one player position at a physical gaming table according to the predetermined rules of blackjack card games utilizing playing cards where all face cards count ten, aces count one or eleven, and all other cards count their face value, in which the processor identifies where each player position makes an initial wager and the dealer position as a virtual dealer randomly distributes an initial player position hand of two cards to each player position and at least one card to the dealer position, the improved method comprising before the dealer position hand is revealed, completed and compared by the processor to the player position hand to determine a processor determined outcome of the blackjack-style card game, the player position exercising a hit-after-double-down option, wherein after the player position place a double down wager and takes a single hit card, the processor accepts a player position forfeit of the double down wager in exchange for an option of drawing more cards and the processor provides at least one card to the player position hand method of claim 10 with virtual images of playing card displayed on the video display after selection with the random number generator, the processor determining game outcomes according to rules stored in a memory accessed by the processor.

* * * * *